US006336298B1

(12) United States Patent
Chou

(10) Patent No.: US 6,336,298 B1
(45) Date of Patent: Jan. 8, 2002

(54) PARTITION COMPOSITION

(76) Inventor: Arthur Chou, 5F, No. 5-1, Lane 271, Nung An Street, Taipei (TW)

( * ) Notice: Subject to any disclaimer, the term of this patent is extended or adjusted under 35 U.S.C. 154(b) by 0 days.

(21) Appl. No.: 09/496,582

(22) Filed: Feb. 2, 2000

(51) Int. Cl.[7] ..... E04H 1/00

(52) U.S. Cl. ..... 52/238.1; 52/243; 52/762; 52/481.2; 52/780; 52/731.5

(58) Field of Search ..... 52/481.2, 586.1, 52/653.1, 731.5, 731.9, 282.3, 434, 476, 767, 762, 764, 775, 777, 783.1, 239, 36.1, 238.1, 243, 780, 282.1

(56) References Cited

U.S. PATENT DOCUMENTS

| | | | | | |
|---|---|---|---|---|---|
| 2,081,368 | A | * | 5/1937 | Pretot | 52/489.1 |
| 3,731,956 | A | * | 5/1973 | Hanley | 52/481.2 |
| 4,667,450 | A | * | 5/1987 | Stefnik et al. | 52/238.1 |
| 5,069,263 | A | * | 12/1991 | Edwards | 160/135 |
| 5,187,908 | A | * | 2/1993 | Losensky | 52/239 |
| 5,415,301 | A | * | 5/1995 | Bruton et al. | 211/183 |
| 5,664,380 | A | * | 9/1997 | Hsueh | 52/126.4 |
| 6,112,485 | A | * | 9/2000 | Beyer et al. | 52/239 |

* cited by examiner

*Primary Examiner*—Carl D. Friedman
*Assistant Examiner*—Jennifer I. Thissell
(74) *Attorney, Agent, or Firm*—Rosenberg, Klein & Lee

(57) ABSTRACT

A partition composition is provided having a plurality of partition units. Each partition unit has two supportive poles of hollow tubular shape and cross-shaped cross-section, an outer baffleplate, and a center baffleplate. Optionally, at least one of the supportive poles is configured as a corner pier. Each supportive pole has two lateral wing portions and two panels on front and rear sides, each of which is formed with a plurality of through holes. A plurality of coupling holes are provided on the lateral wing portions; and, the outer baffleplates have a plurality of hooks which correspond to the coupling holes formed on their lateral sides facing the lateral wing portions. The two outer baffleplates are parallel arranged to extend between two supportive poles such that an interspace is formed between the two parallel outer baffleplates. A center baffleplate is provided within the interspace. The partition composition can be easily assembled and disassembled. Once disassembled, the partition composition's components can be reused to avoid waste of resources. The through holes on the supportive poles enable convenient arrangement of household or office utility equipment on the partition composition, with the hollow space within each supportive pole or pier providing an electrical conduit.

4 Claims, 15 Drawing Sheets

PARTITION COMPOSITION

FIELD OF THE INVENTION

The present invention relates to a partition composition, especially to a partition composition, which has module-fashion design and can be easily assembled or disassembled to comply with large or small space.

BACKGROUND OF THE INVENTION

The conventional partition composition is generally assembled with groundwork frame composed a plurality of stubs on floor or between floor and ceiling. Afterward, baffle plates are arranged to cover the openings of the frame by nail or screw, thus finishing partition composition for house or office. However, the assembling of the conventional partition composition is cumbersome, especially when the assembled partition composition is modified to accommodate doors or windows. The conventional partition composition is often disassembled destructively for a new layout. The disassembled partition composition generally can not be recycled for new usage. Therefore, the cost of arranging partition composition is high.

Moreover, the conventional partition composition is generally designed for space separation. Therefore, the furniture such as bookshelf, table, chest or cabinet is placed on floor. Otherwise, the furniture is arranged in a destructive way. For example, the hang-up chest, wall lamp, dressing table and towel rail is fixed on partition composition by nail or screw. In other word, the conventional partition composition can not provide versatile arrangement for furniture or office utility. Moreover, the electric conduit and socket can not be conveniently changed position on the conventional partition composition once being allocated.

It is an object of the present invention to provide a partition composition unit comprising two supportive poles of hollow tubular shape and cross-shaped cross-section, an outer baffleplate, and a center baffleplate. Optionally, at least one supportive pole is configured as a corner pier. Therefore, the partition composition based on the partition composition unit can be easily assembled and disassembled.

It is another object of the present invention to provide a partition composition unit by which the household or office utility can be easily assembled thereon.

It is still another object of the present invention to provide a partition composition unit by which the electrical conduit and switch for computer and telecommunication can be easily assembled thereon.

It is still another object of the present invention to provide a partition composition unit by which part of the partition can be easily modified and removed to save cost.

The various objects and advantages of the present invention will be more readily understood from the following detailed description when read in conjunction with the appended drawing, in which:

DETAILED DESCRIPTION OF THE PREFERRED EMBODIMENT

Figure 1:
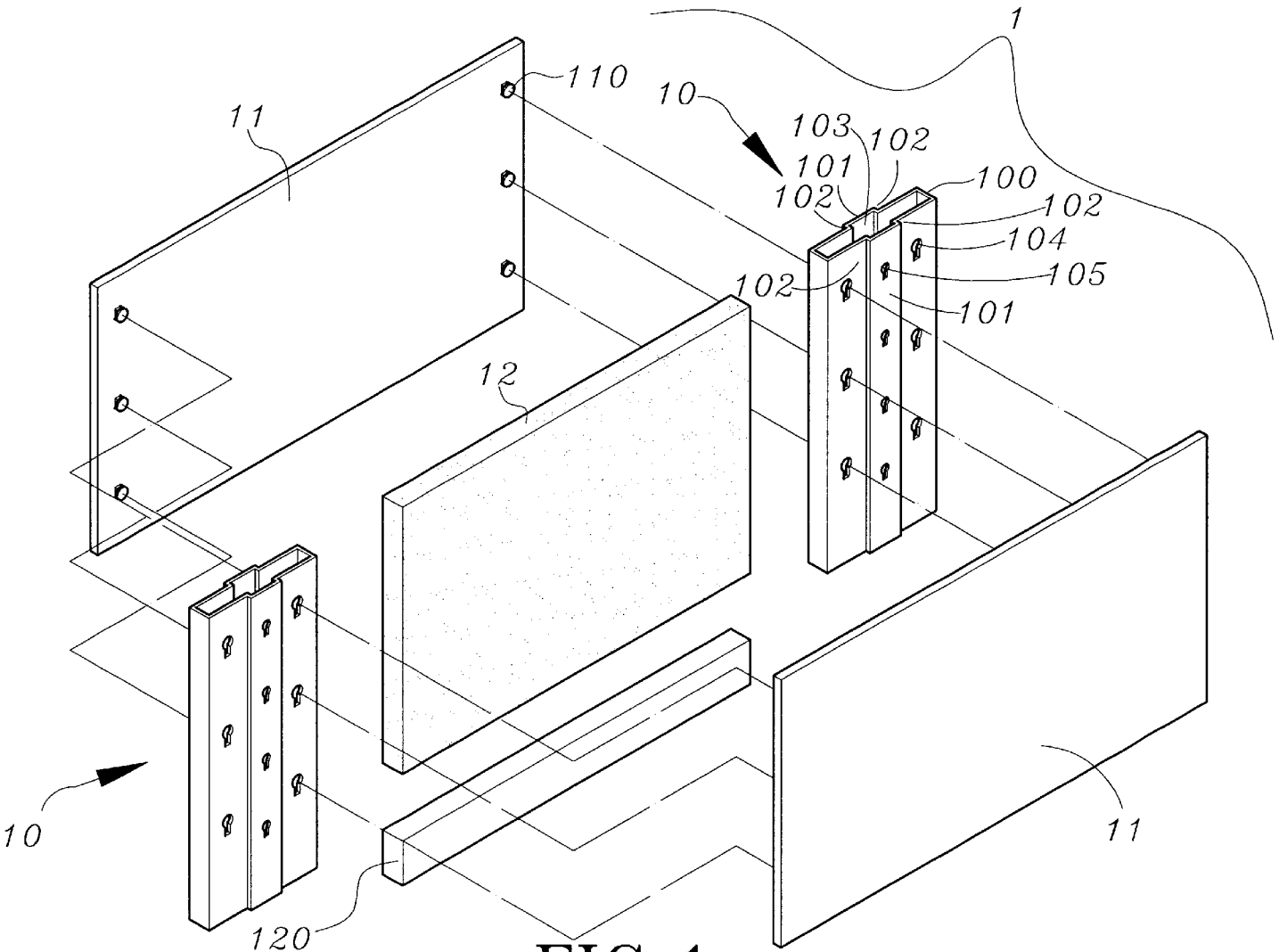
FIG. 1 shows the exploded view of the partition unit according to a preferred embodiment of the present invention.
Figure 2:
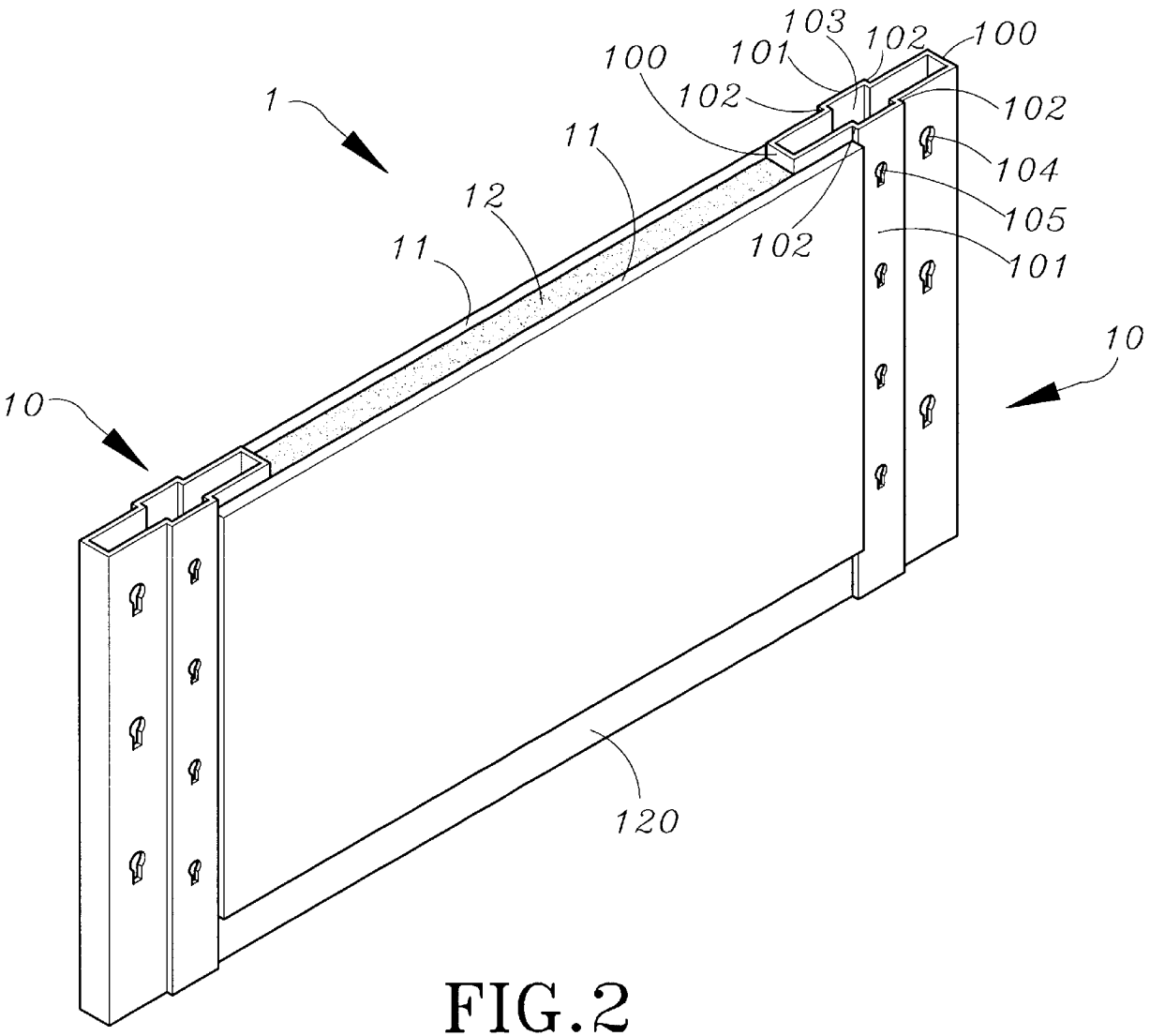
FIG. 2 shows the perspective view of the partition unit according to a preferred embodiment of the present invention.

The partition composition according to the present invention comprises a plurality of partition units. FIG. 1 shows the exploded view of the partition unit according to a preferred embodiment of the present invention, and FIG. 2 shows the perspective view of the partition unit according to a preferred embodiment of the present invention. The partition unit 1 comprises two supportive poles 10, two outer baffleplates and a center baffleplate 12.

The supportive poles 10 are erectly arranged between floor and ceiling in household and office application, or on the floor in exhibition application. The supportive pole 10 is cross-shape hollow tube with two lateral wings 100 and two panels 101 (front and rear sides). The width of the two lateral wings 100 is smaller than the separation between the two panels 101 such that steps 102 are formed. Each supportive pole 10 has hole 103 for conductive wire. The lateral wing 100 has a plurality of coupling holes 104 near the step 102 and the panel 101 has a plurality of through holes 105.

The outer baffleplate 11 has a plurality of hooks 110 or other coupling means corresponding to coupling holes 104 on the inner sides facing the supportive poles 10 such that the outer baffleplate 11 is retained on the steps 102 on the lateral side thereof. The outer baffleplate 11 is bridged between two supportive poles 10 by locking the hooks 110 into the coupling holes 104 such that an interspace is formed between two outer baffleplates 11. Moreover, the thickness of the outer baffleplate 11 is slightly larger than the projecting height of the panel 101 with respect to the lateral wing 100 such that the panel 101 is indented when the outer baffleplates 11 are assembled on the supportive poles 10. The indentation of the panel 101 can provide aesthetic visual effect.

The center baffleplate 12 is placed in the interspace between the two supportive poles 10 and the two outer baffleplates 11. The center baffleplate 12 may adopt soundproof material and is provided a baseboard 120 at the bottom thereof in advance.

To complete a partition arrangement for house or office, a user can assemble a partition unit 1 comprising two supportive poles 10, two outer baffleplates 11, and a center baffleplate 12, or with an additive baseboard 120. Afterward, the partition composition is finished by assembling a plurality of partition units 1, thus providing a partition for house or showground. To disassemble the partition composition, a user can part the partition composition into a plurality of partition units 1 in reversed order. Therefore, the inventive partition composition provides versatile application with reduced cost.

Figure 3:
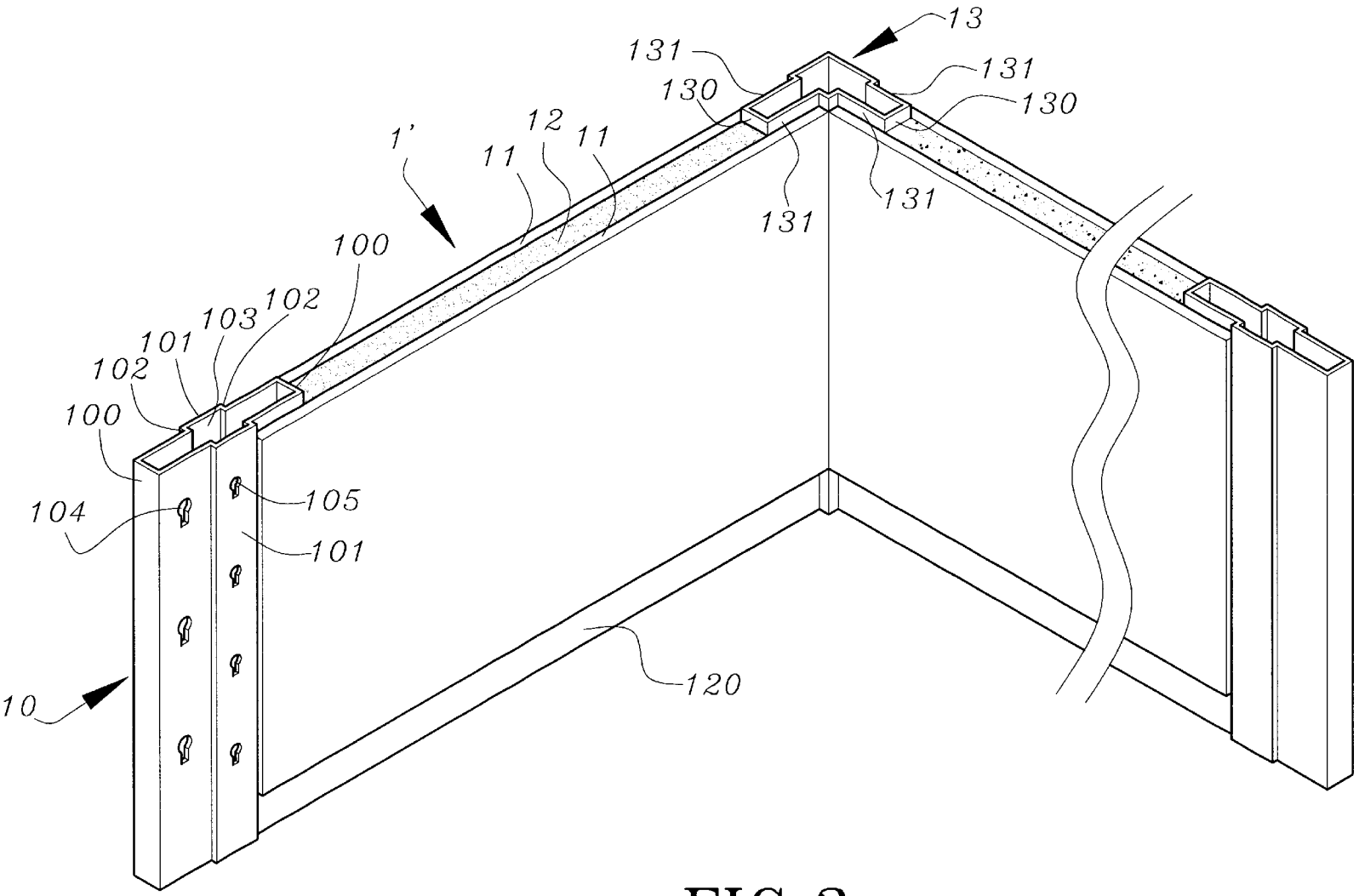
FIG. 3 shows the perspective view of the partition unit according to another preferred embodiment of the present invention.
Figure 4:
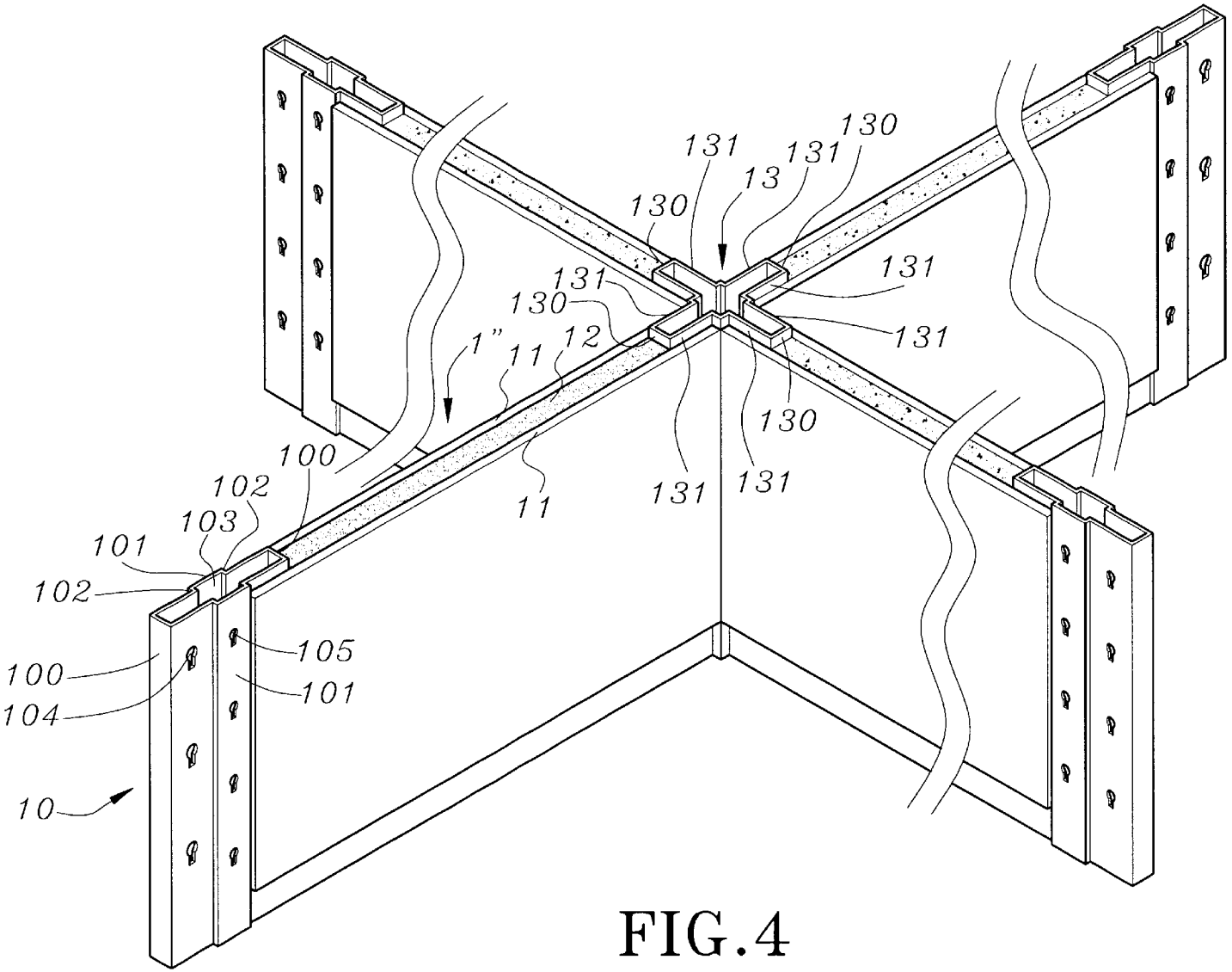
FIG. 4 shows the perspective view of the partition unit according to another preferred embodiment of the present invention.

FIG. 3 shows the perspective view of the partition unit 1' according to another preferred embodiment of the present invention. The partition unit 1' comprises one hollow supportive pole 10, one L-shape pier 13, two outer baffleplates 11 and a center baffleplate 12. The L-shape pier 13 has two wing portions 130 and corresponding steps 131. Two adjacent partition units 1' are bridged by one L-shape pier 13 to form an L-shaped partition composition. FIG. 3 shows the perspective view of the partition unit 1" according to another preferred embodiment of the present invention. The pier 13 is cross shape with four wing portions 130 and corresponding steps 131. Therefore, four adjacent partition units 1" are bridged by one cross shape pier 13 to form a cross shaped partition composition.

The hole 103 of the supportive pole 10 can be used to accommodate wiring as shown in FIG. 3. Moreover, the through holes 105 of the panel 101 can be optionally provided with power socket 20, telephone line or telecommunication socket 21, coaxial cable socket 22, power switch 23 corresponding to the practical usage.

Figure 5:
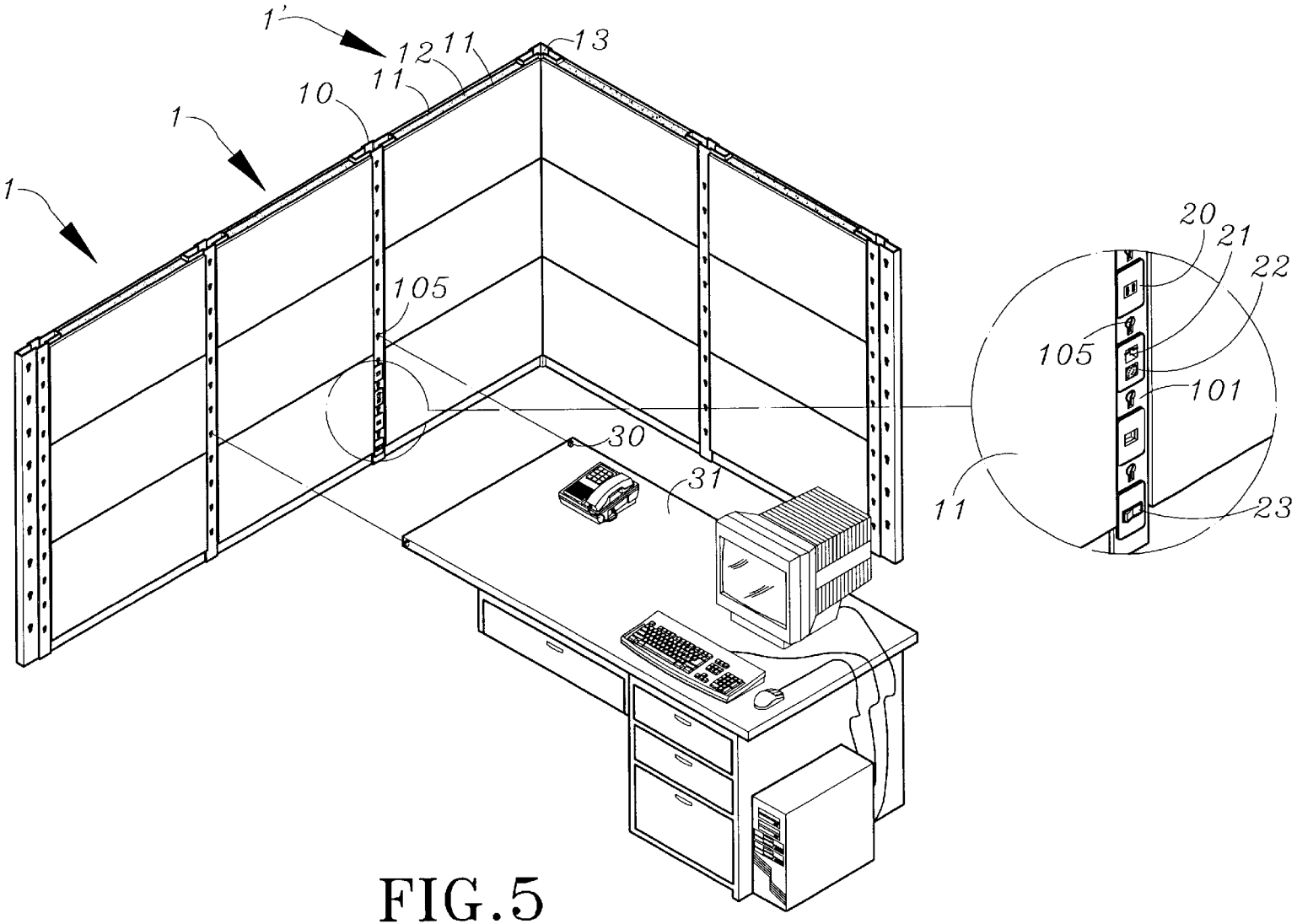
FIG. 5 shows the first application of the partition composition according to the present invention.
Figure 6:
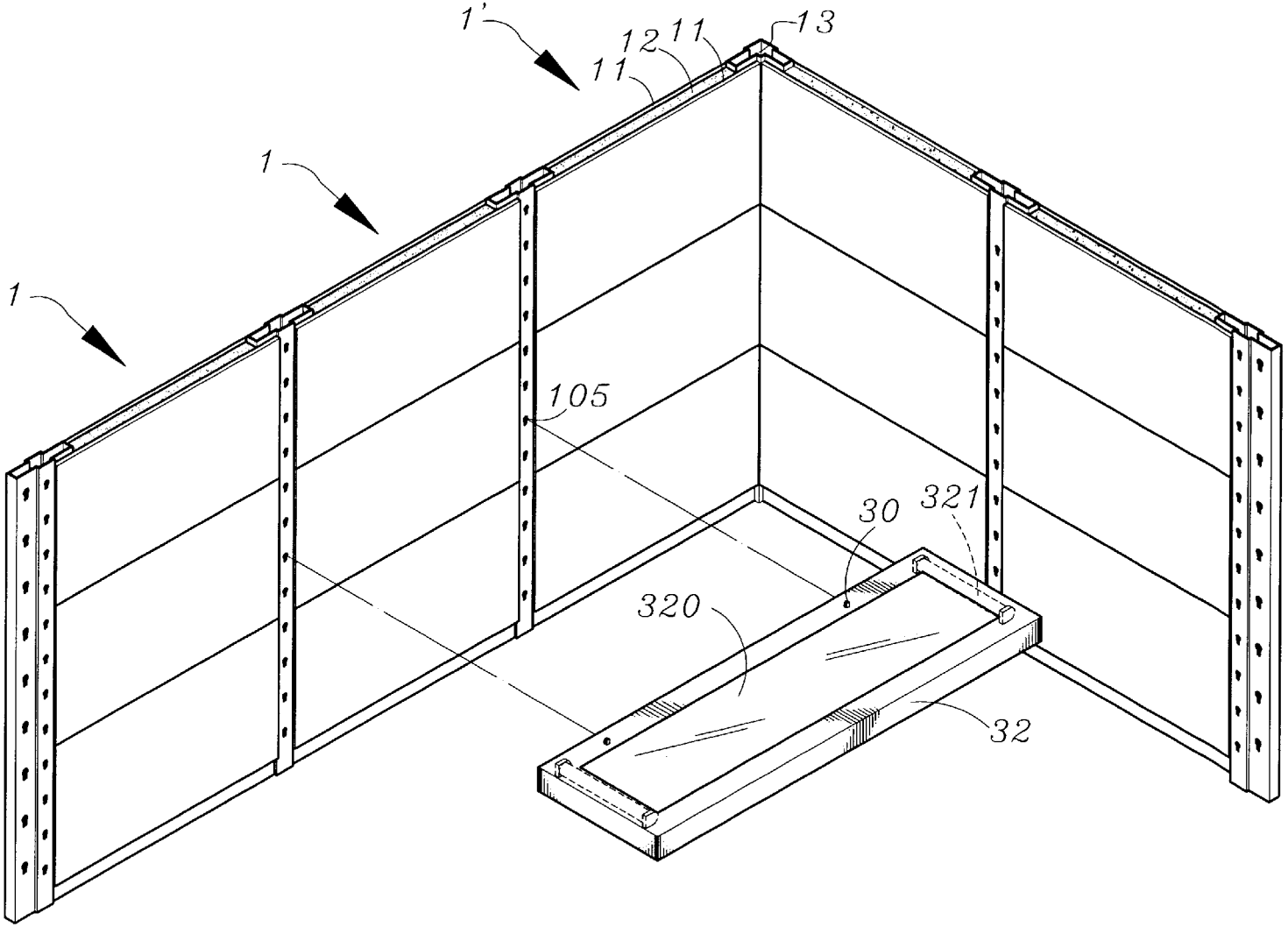
FIG. 6 shows the second application of the partition composition according to the present invention.
Figure 7:
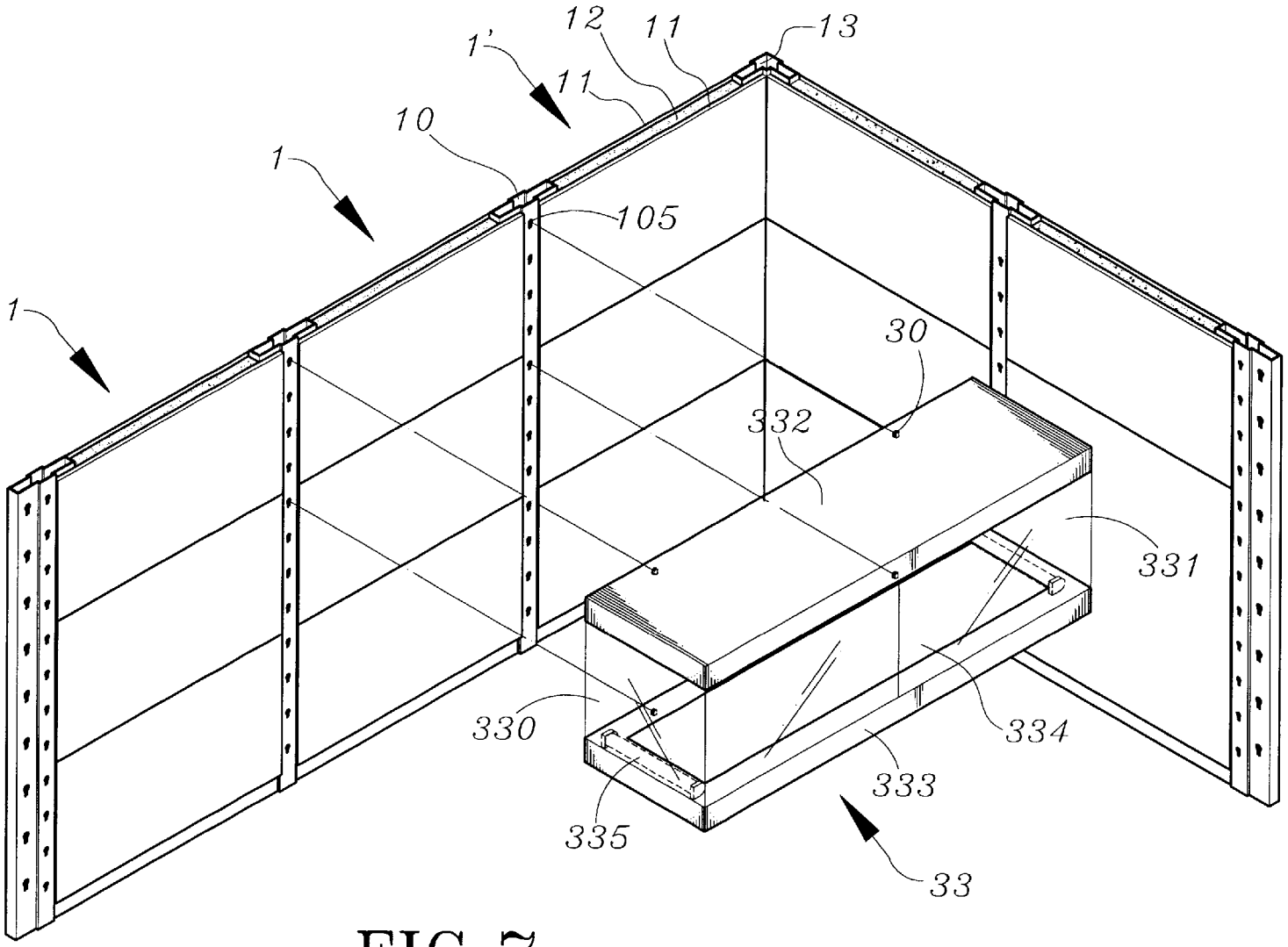
FIG. 7 shows the third application of the partition composition according to the present invention.
Figure 8:
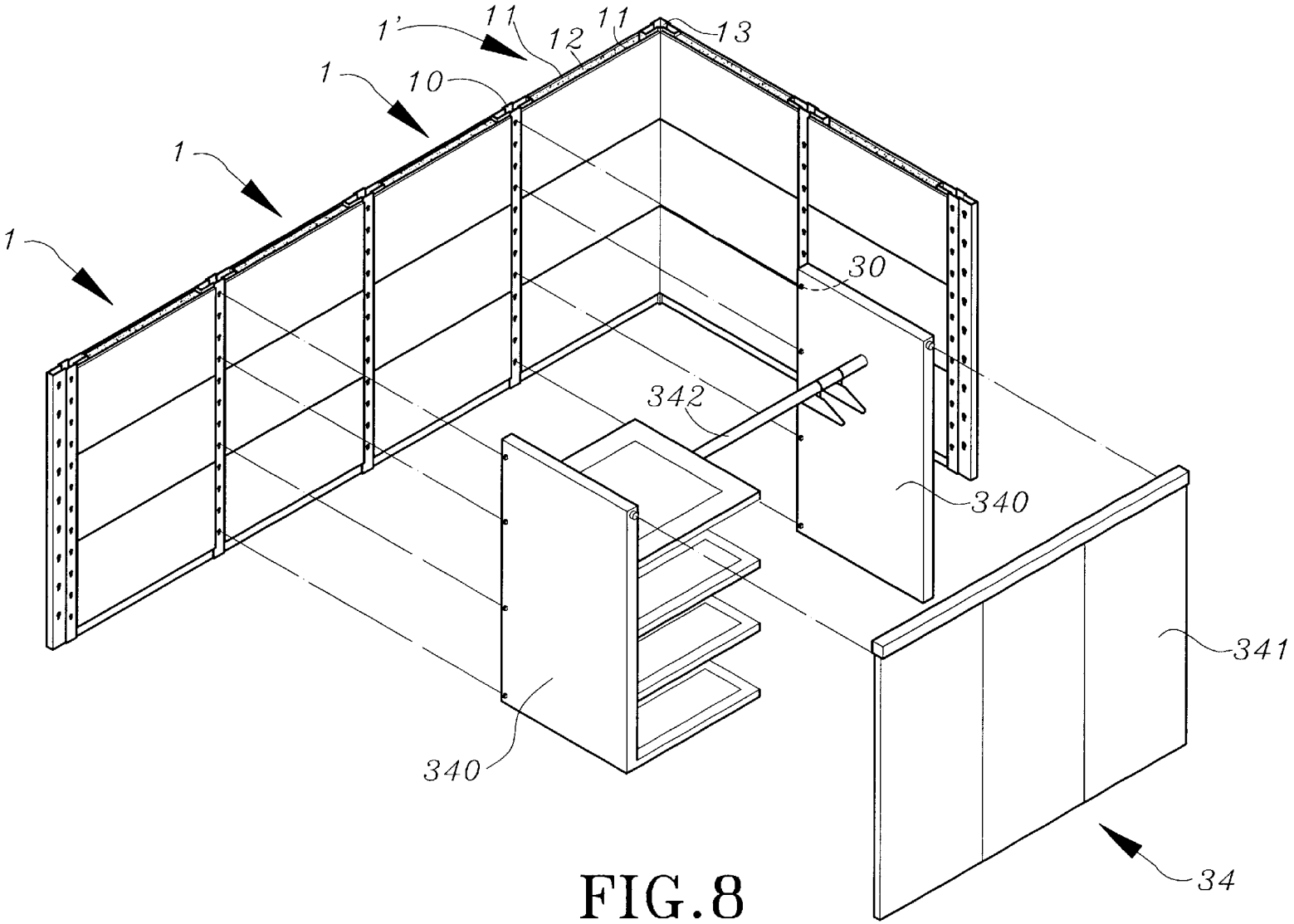
FIG. 8 shows the fourth application of the partition composition according to the present invention.
Figure 9:
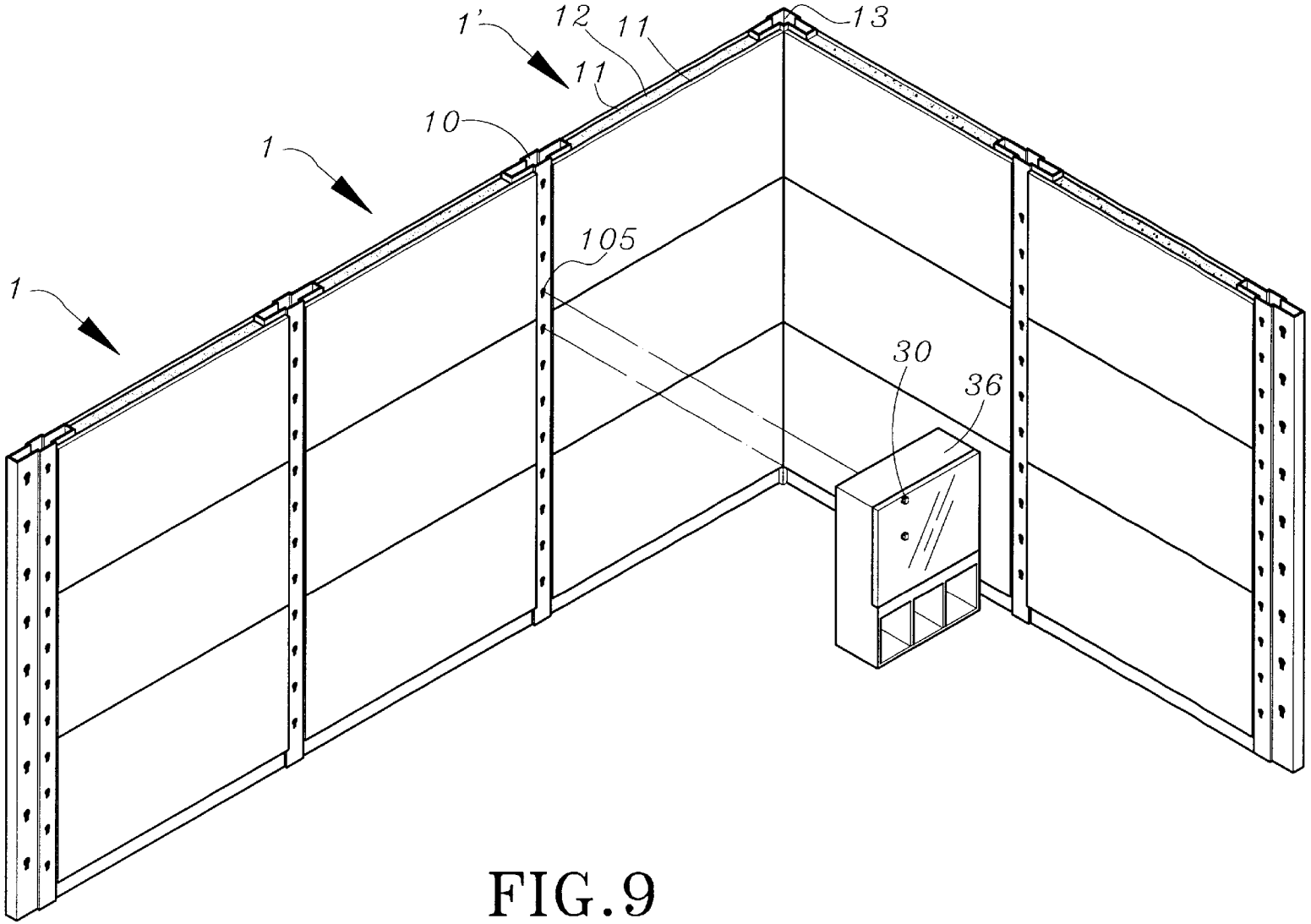
FIG. 9 shows the fifth application of the partition composition according to the present invention.
Figure 10:
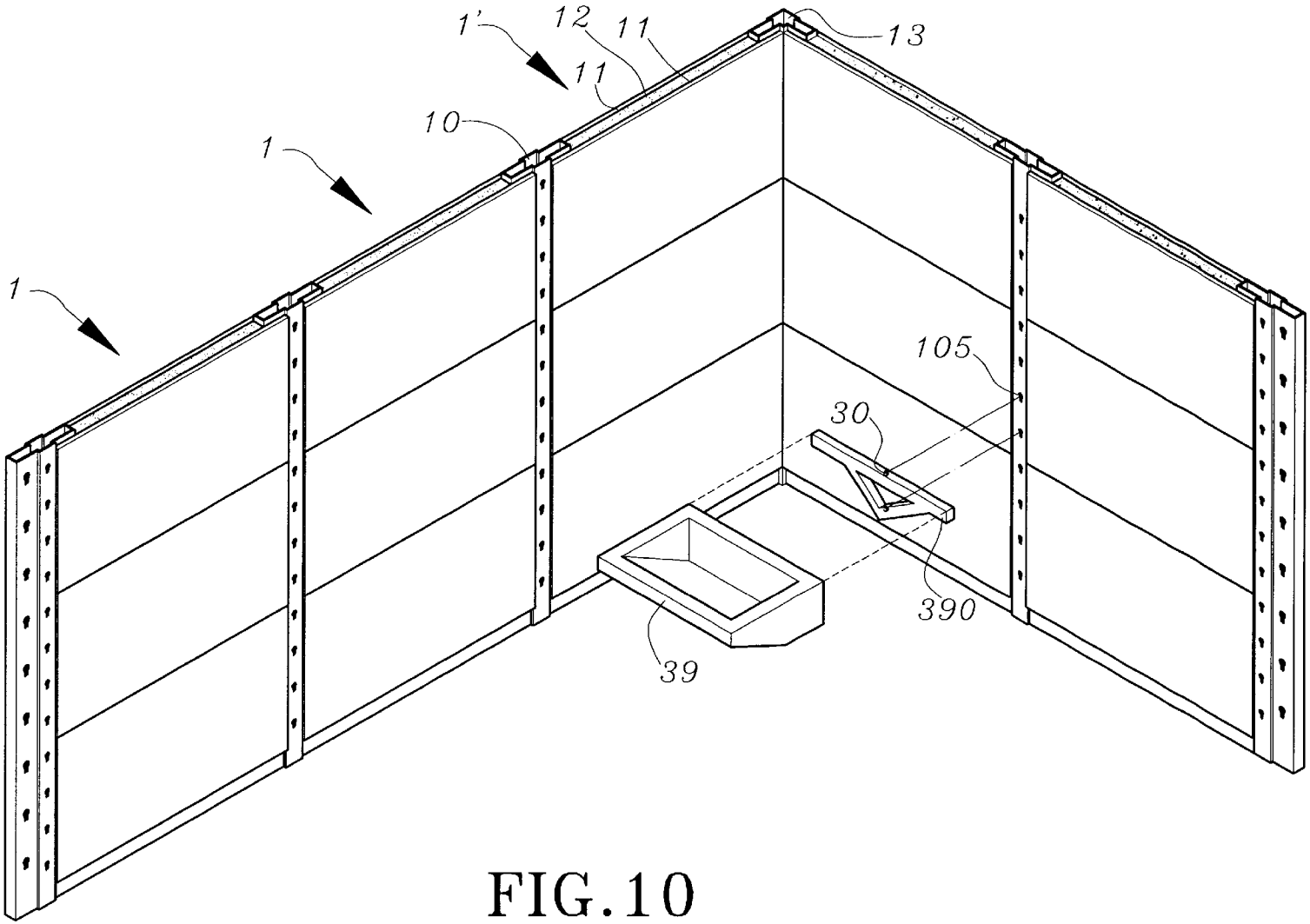
FIG. 10 shows the sixth application of the partition composition according to the present invention.
Figure 11:
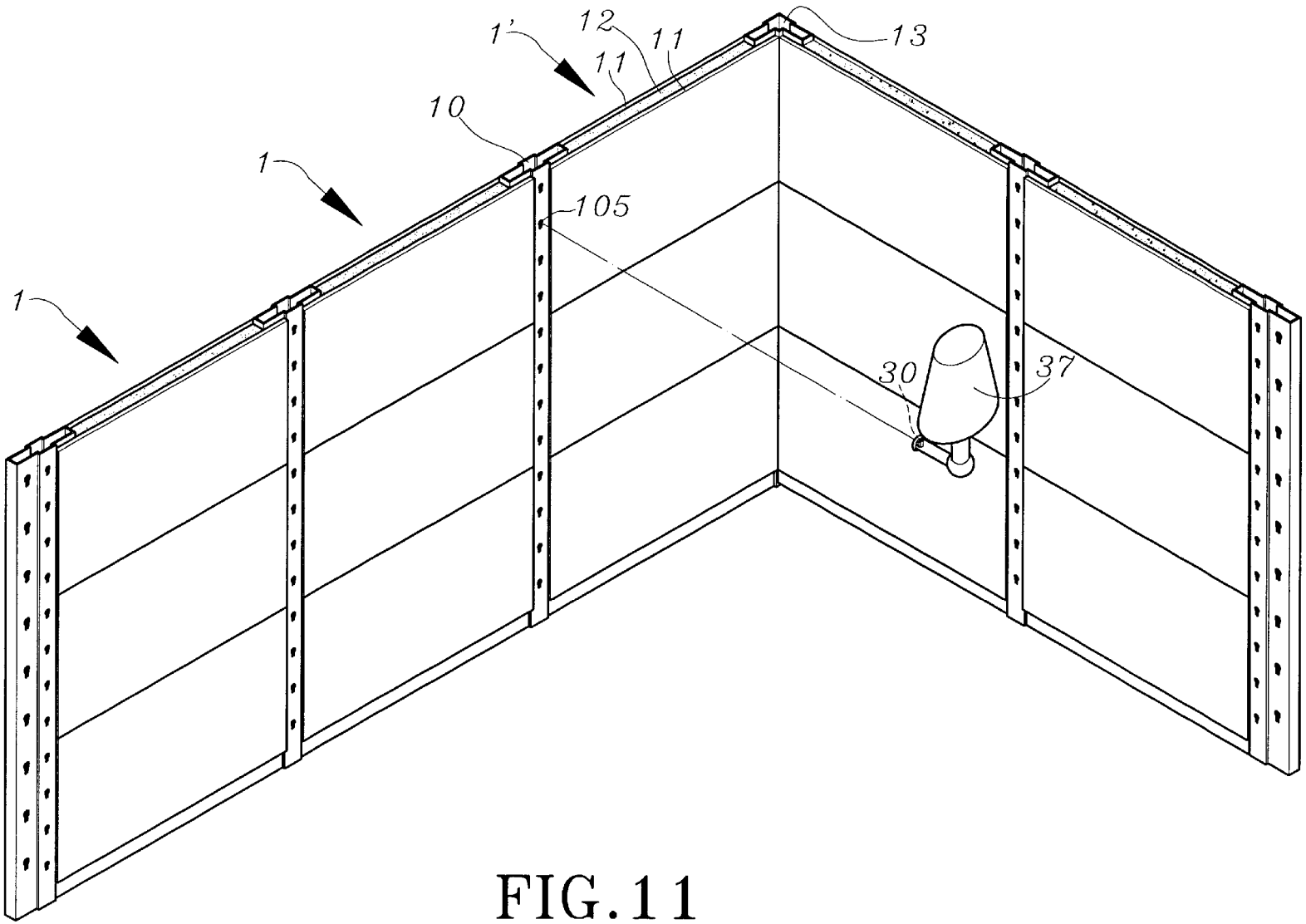
FIG. 11 shows the seventh application of the partition composition according to the present invention.
Figure 12:
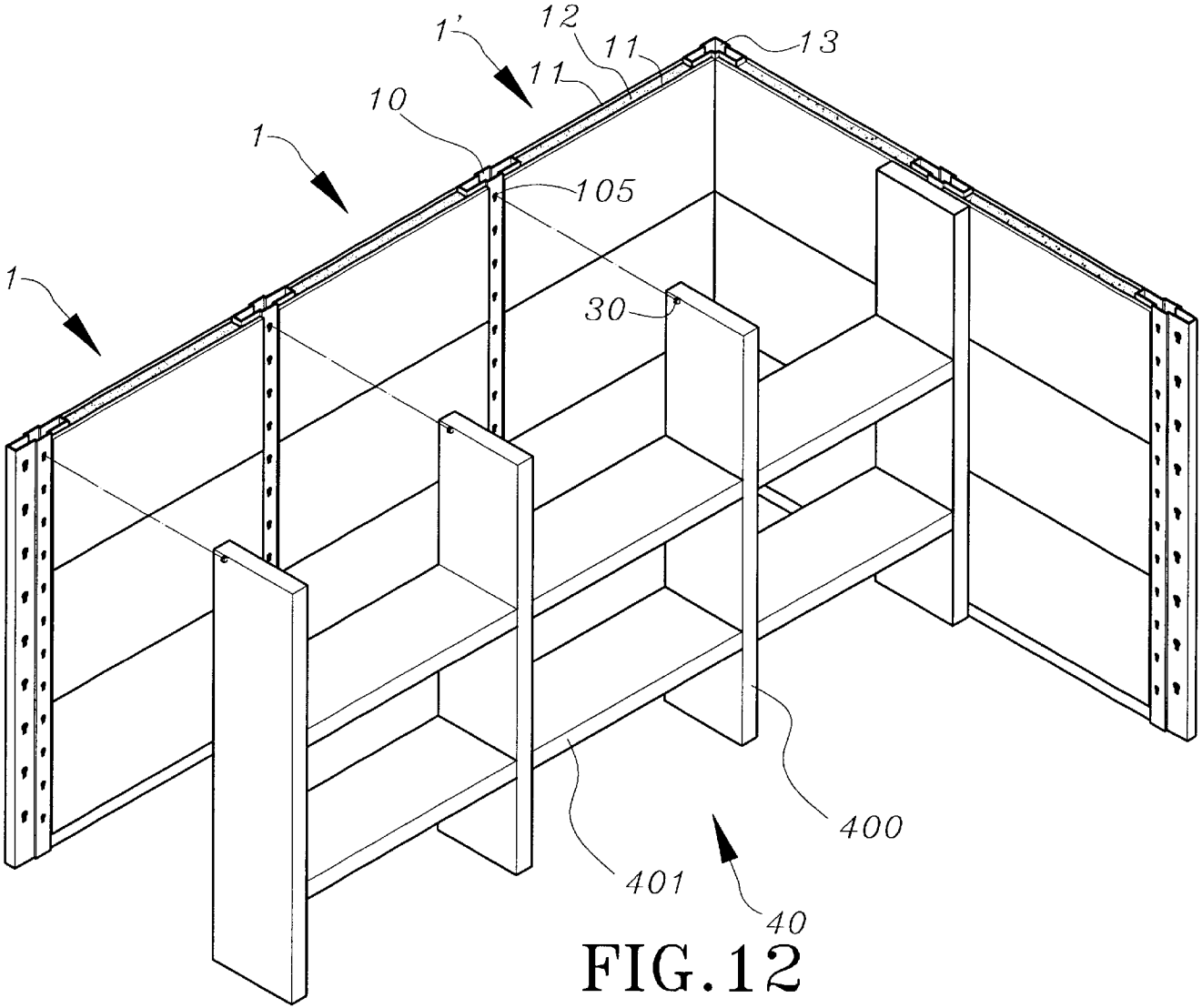
FIG. 12 shows the eighth application of the partition composition according to the present invention.
Figure 13:
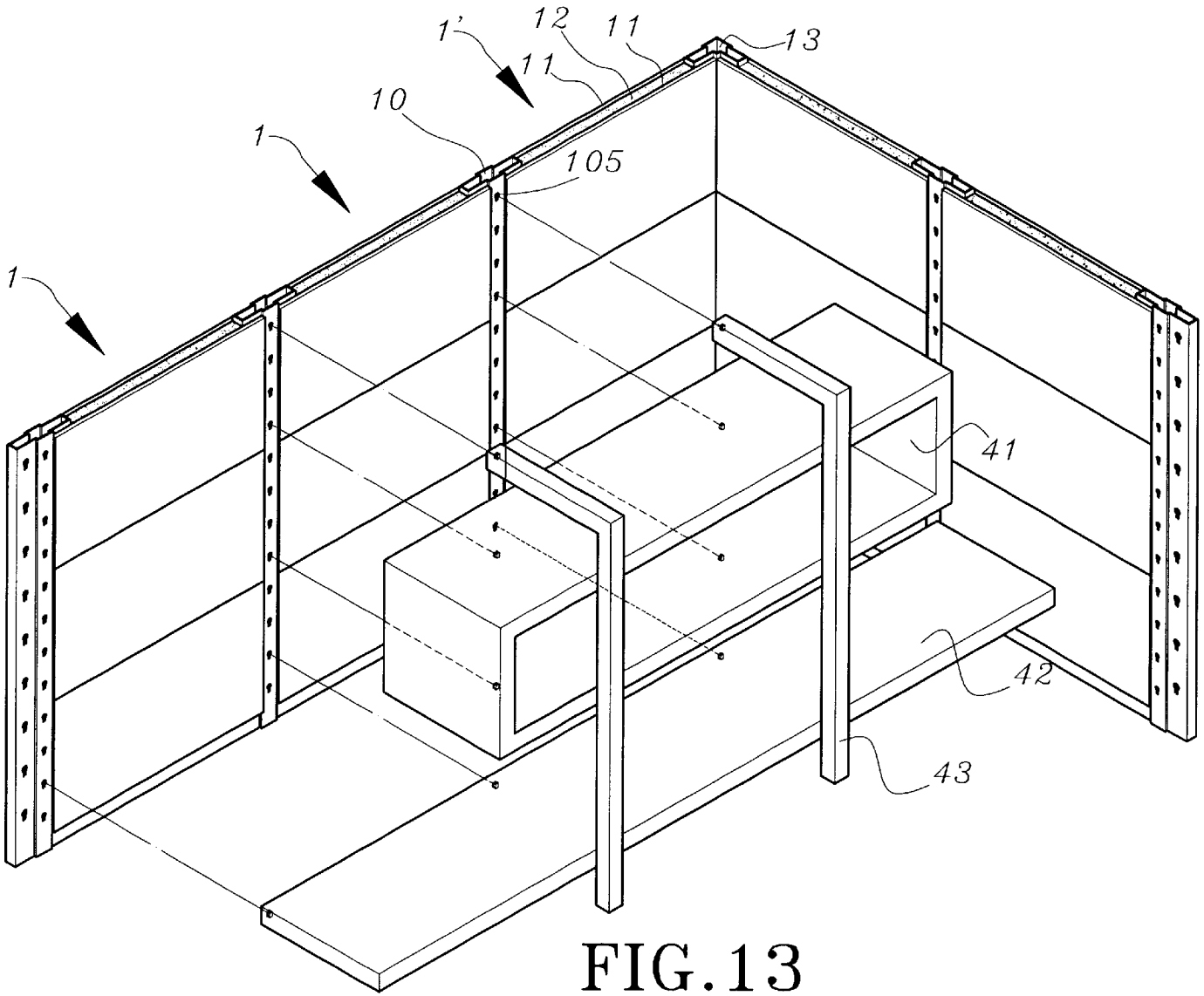
FIG. 13 shows the ninth application of the partition composition according to the present invention.

Moreover, the through holes 105 of the panel 101 allows the engagement of hook 30 to hang business utility or household utility thereon. FIG. 5 shows the application of the partition composition according to the present invention. As shown in this figure, a table 31 is hung on two supportive poles 10. FIG. 6 shows the second application of the partition composition according to the present invention. As shown in this figure, a bolster 32 has upper and lower reinforced glass plates 320 and a hollow interspace therebetween to contain a lamp 321. The bolster 32 can be hung on two supportive poles 10 for supportive function and provide romantic feeling by the lamp 321. FIG. 7 shows the third application of the partition composition according to the present invention. As shown in this figure, a hang-up chest 33 is hung on the supportive poles 10. The hang-up chest 33 comprises two transparent glass plates 330 on two lateral sides thereof, a glass door 331 on front side thereof, opaque top plate 332 and bottom plate 333 on top and bottom sides thereof. The bottom of the top plate 332 and the top of the bottom plate 333 are provided with sanding glass plates 334 containing a lamp 335 therein to provide pleasing lightening. FIG. 8 shows the fourth application of the partition composition according to the present invention. As shown in this figure, a wardrobe 34 comprising lateral plate 341, hanging rod 342 is retained on the supportive poles 10. FIG. 9 shows the fifth application of the partition composition according to the present invention. As shown in this figure, a dressing table 36 with layer utility is arranged on the supportive pole 10. FIG. 10 shows the sixth application of the partition composition according to the present invention. As shown in this figure, a supportive rack 390 is arranged on the supportive pole 10 and a water sink 39 with conduit is arranged on the supportive rack 390. FIG. 11 shows the seventh application of the partition composition according to the present invention. As shown in this figure, a wall lamp 37 is hung on the supportive pole 10. FIG. 12 shows the eighth application of the partition composition according to the present invention. As shown in this figure, a plurality of upright plates 400 are fixed on the supportive pole 10 to enhance the stability of the partition composition. Moreover, a plurality of horizontal plates 401 are provide to form a composite chest 40. FIG. 13 shows the ninth application of the partition composition according to the present invention. As shown in this figure, an external rack 43 is assembled with the inventive partition composition. Afterward, a hang-up chest 41 and a horizontal plate 42 are arranged on the assembly according to user's need. In a word, light utilities can be hung on the inventive partition composition according to user's need. The inventive partition composition has versatile usage and pleasing outlook.

Figure 14:
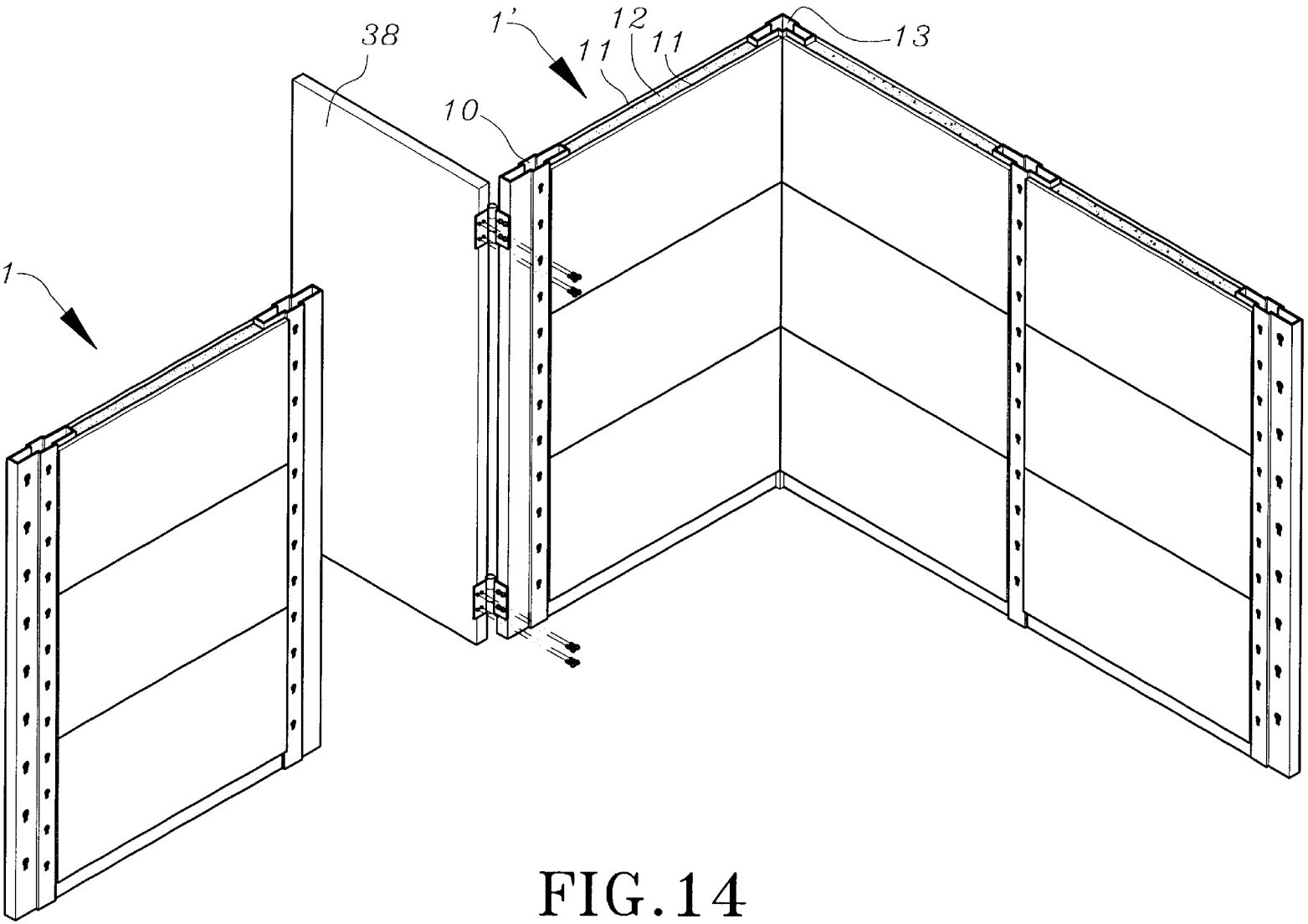
FIG. 14 shows the tenth application of the partition composition according to the present invention.

When the partition composition requires to be modified, the pier 13 and supportive pole 10 can be disassembled and moved to change the partition. FIG. 14 shows the tenth application of the partition composition according to the present invention. As shown in this figure, to assemble a door 38 or glass window on the partition composition, a set of outer baffleplate 11, center baffleplate 12 and baseboard 120 are disassembled from the partition composition, then a door 38 is easily arranged on the supportive pole 10. The disassembled material can be reused to save resource.

Figure 15:
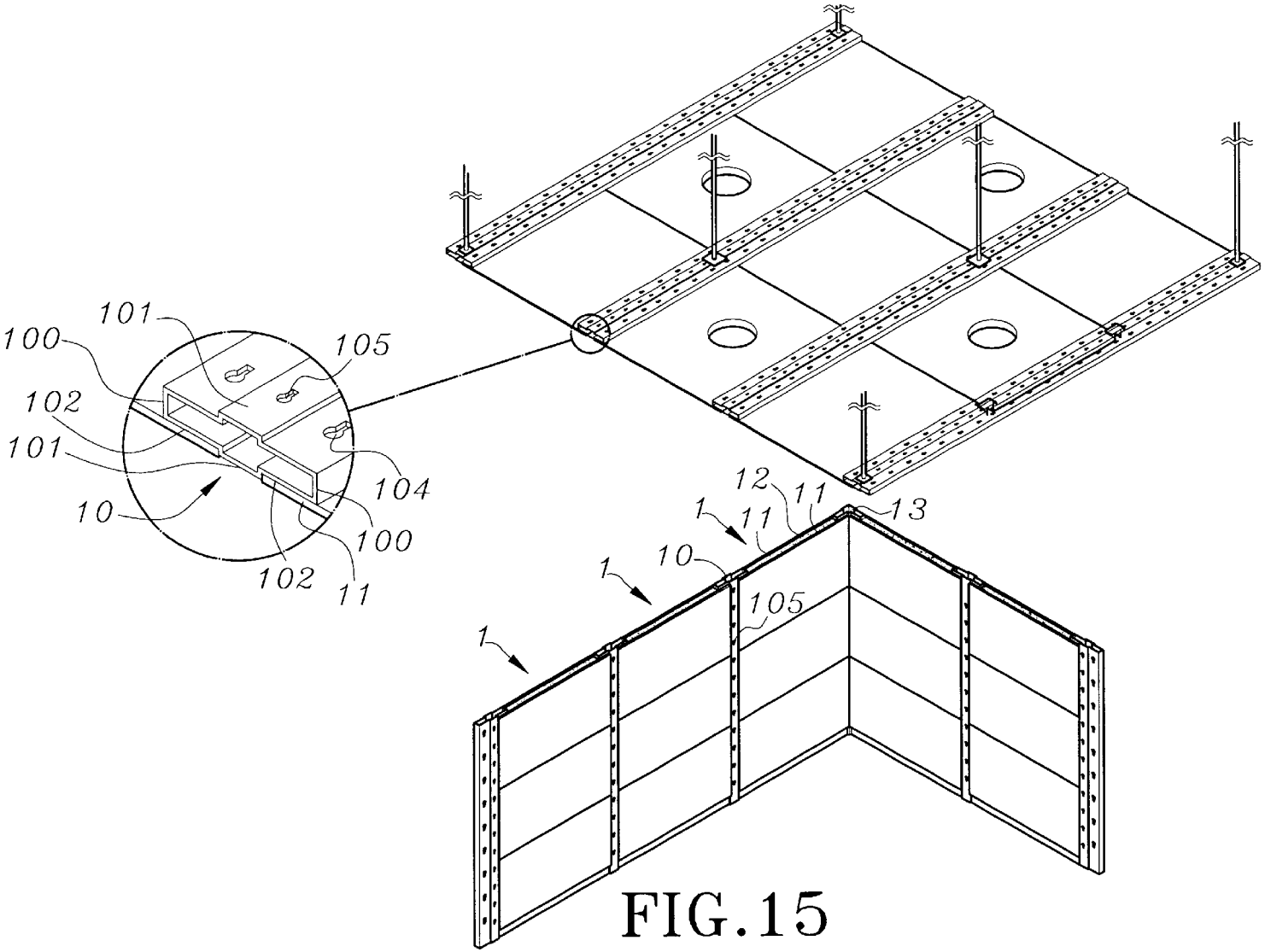
FIG. 15 shows the eleventh application of the partition composition according to the present invention.

More particularly, the outer baffleplate 11 can be decorated with wooden cover, thin brick or wall cloth with user's favor pattern. The panel 101 of the supportive pole 10 can be covered with covering plate to hide the unused through holes 105 to keep integrality of the partition composition. Moreover, the inventive partition composition can also be used to three dimensional space division beside the above mentioned application. FIG. 15 shows the eleventh application of the partition composition according to the present invention. As shown in this figure, the supportive pole 10 is hung by steel rods and the outer baffleplate 11 is retained on the supportive pole 10 such that lamps can be arranged on the outer baffleplate 11 and more broad usage can be provided.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A partition assembly comprising:

(a) at least a pair of supportive poles spaced one from the other, each said supportive pole having a substantially tubular configuration, each said supportive pole including an intermediate portion and a pair of lateral wing portions extending therefrom, said intermediate portion having formed on opposing sides thereof front and rear panels, said front and rear panels each being raised relative to each said lateral wing portion to define a pair of step portions, said front and rear panels each having formed therein a plurality of through holes; and, (b) at least a pair of outer baffleplates each extending substantially in parallel between said supportive poles, each said baffleplate having lateral end portions each engaging one said supportive pole lateral wing portion, each said baffleplate lateral end portion being limited by one said supportive pole step portion.

2. The partition assembly as recited in claim 1 further comprising a soundproofing center baffleplate disposed within an interspace defined between said outer baffleplates.

3. The partition assembly as recited in claim 1 wherein each said lateral wing portion of said supportive poles has formed therein a plurality of coupling holes, and each of said outer baffleplates have formed at said lateral end portions thereof a plurality of coupling hooks releaseably engaging respective ones of said lateral wing portion coupling holes.

4. The partition assembly as recited in claim 1 wherein at least one said supportive pole is configured as a corner pier, said corner pier having said lateral wing portions extending from said intermediate portion in an angularly offset manner one relative the other.

* * * * *